United States Patent [19]

Greck et al.

[11] 4,310,106

[45] Jan. 12, 1982

[54] SIDE OUTLET PORTABLE CONTAINER UNLOADER

[75] Inventors: Eugene Greck, Westfield; Eugene A. Wahl, Glen Ridge; Richard C. Wahl, Verona, all of N.J.

[73] Assignee: Vibra Screw, Incorporated, Totowa, N.J.

[21] Appl. No.: 99,104

[22] Filed: Nov. 30, 1979

[51] Int. Cl.[3] ..... B65G 27/20

[52] U.S. Cl. ..... 222/161; 222/200; 414/415

[58] Field of Search ..... 222/161, 196, 198, 199, 222/200; 414/415

[56] References Cited

U.S. PATENT DOCUMENTS

| | | | |
|---|---|---|---|
| 2,044,326 | 6/1936 | Pickell . | |
| 2,801,773 | 8/1957 | Vitkin | 222/161 |
| 2,808,081 | 10/1957 | Orsini et al. | 222/161 X |
| 3,123,107 | 3/1964 | Kappler . | |
| 3,216,626 | 11/1965 | Gaucet . | |
| 3,334,787 | 8/1967 | Sugimoto et al. | 222/196 X |
| 3,729,121 | 4/1973 | Cannon . | |
| 3,854,612 | 12/1974 | Snape | 222/196 X |
| 3,970,123 | 7/1976 | Poulton et al. . | |

*Primary Examiner*—Joseph J. Rolla

*Attorney, Agent, or Firm*—Leitner, Palan, Martin & Bernstein

[57] ABSTRACT

An unloader for portable containers including tension hanger arms suspending a vibratory support from a fixed support and pivotally connected to each support to limit the vibratory motion to horizontal, reciprocal, rectilinear motion. For side outlet portable containers, the vibratory support includes a first frame portion inclined relative to the horizontal and a second frame portion, with a discharge orifice, extending perpendicular from the lower horizontal edge of the first frame portion.

19 Claims, 5 Drawing Figures

FIG. 2
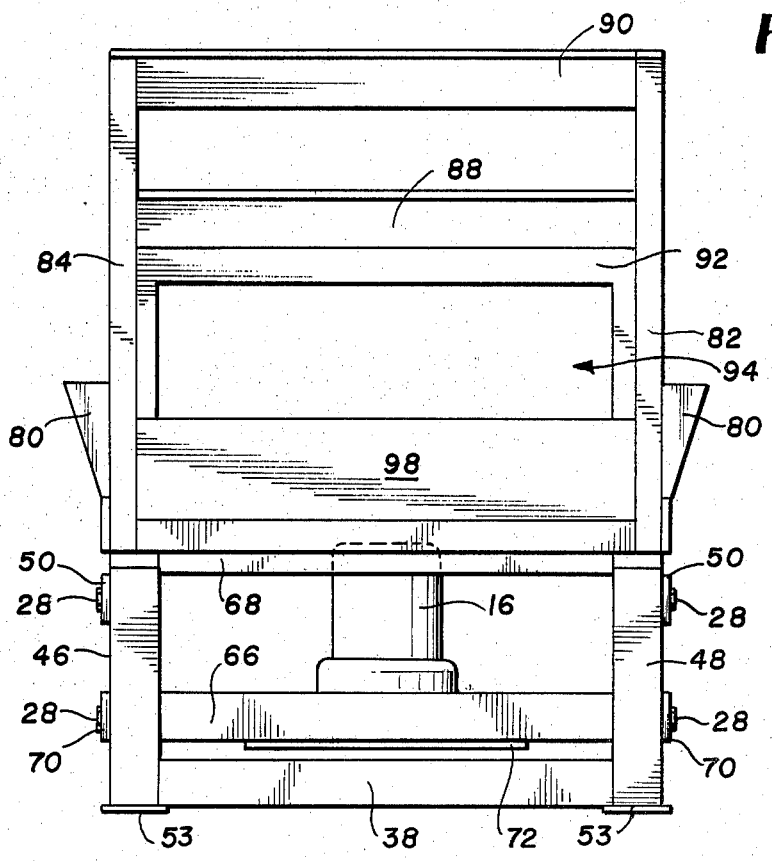
FIG. 3
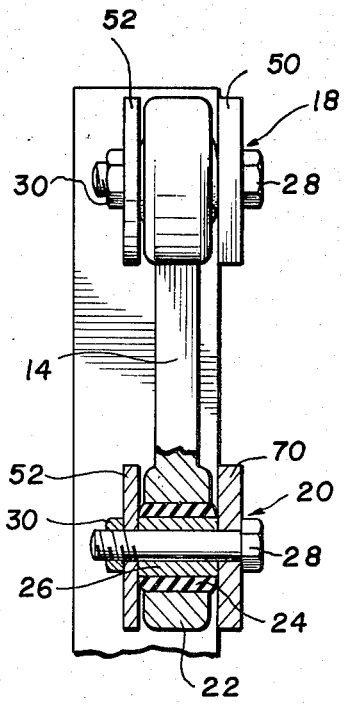
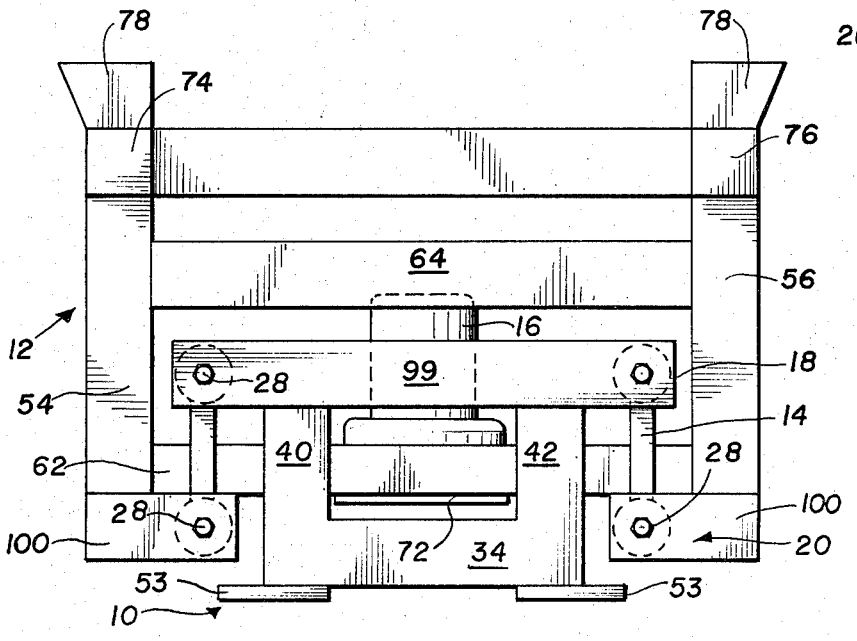
FIG. 4

SIDE OUTLET PORTABLE CONTAINER UNLOADER

BACKGROUND OF THE INVENTION

The present invention relates generally to unloaders for portable containers and more specifically to an improved unloader suspension system and to an unloader specifically for side outlet portable containers.

Powdered, granulate or other particulate solid materials are transported, stored and dispensed in industrial processes from large portable containers or bins. The portable containers are delivered to a position where they are to be dispensed.

To aid the dispensing or discharge of the particulate material from the portable container, vibration means is generally provided. One type of prior art device has the portable container supported by a fixed frame upon which is mounted a dish-like material receiving means which is vibrated by a gyrator and which is isolated from the fixed frame by resilient compressional isolators. The dish-like receiving member and baffle which is received in the outlet of the portable container agitates and aids the dispensing of the particulate material. An example of this type of system is illustrated in U.S. Pat. No. 3,970,123. In another example of prior art, the portable bin is received by a vibrating frame which is interconnected to a fixed frame by compressional isolators. The vibration of the vibrational frame aids dispensing of the particulate material in the container. A typical example of the system is found in U.S. Pat. No. 3,854,612.

The compressional isolators by definition compress in response to the weight of the container and its contents. Since the weight of the container and its contents vary during dispensing, the height of the discharge nozzle may also vary. This variable displacement of the discharge nozzle from the container is undesirable in dispensing processes where a closely measured volume of material must be dispensed onto a moving belt or other flat conveyor using a fixed gate. The three sides of the nozzle and the belt in combination with the discharge gate determine the volume. The leading edge of the discharge gate causes a strike off. Thus the height of the nozzle will affect the volume per unit length of the belt, and consequently, any variation in height of the nozzle will affect this volume which must be controlled closely. It is obvious that compressional isolation systems for portable container unloaders will vary the height of the discharge nozzle with the weight of the material in the container or the discharge nozzle, thus is undesirable where the delivery volume must be accurate to be controlled. Another disadvantage of height variation of compression type isolators is when the unloader discharge nozzle is sealed (connected) to a downstream feeder in a dispensing process via a flexible sleeve. Variation in height of the nozzle can put undue strain on the seal causing it to slip from the surfaces on the unloader nozzle or downstream feeder to which it is clamped, thus ruining the dust-tight seal gained from use of the sleeve and causing material to leak out to the surroundings. Also, the response of compression-pression-type isolators vary with age and temperature and thus adds other uncontrollable factors. Since compressional isolators are dynamic and have moving parts, they have a limited useful life. The portable containers are generally placed and removed from the unloaders by fork lift trucks. Common pneumatic and liquid filled compressional isolators are susceptible to puncture from any inevitable bang of the fork of the lift trucks. Similarly, other dynamic compressional isolators may also be severely damaged. Thus, there exists a need for a static isolator system which is more rugged.

While the majority of the industry has directed its efforts to unloaders for bottom outlet portable containers, some efforts have been made to provide equivalent unloaders for side outlet portable containers. These efforts have been primarily directed to elevating a portion of the platform to an incline after the container is positioned upon the platform. These efforts have produced a device of unnecessary mechanical complexity which which results in increased costs and shortened useful life. Thus there exists a need for a more practical unloader for side outlet portable containers.

SUMMARY OF THE INVENTION

An object of the present invention is to provide an unloader for portable containers which, when used in combination to dispense or discharge onto a belt, enhances conveying accuracy.

Another object of the present invention is to provide an improved suspension system for portable container unloaders which avoids elevation change in response to vertical loading while permitting complete freedom of movement horizontally.

Still another object of the present invention is to provide a suspension system having a greater useful life than the compression isolation systems of the prior art.

An even further object of the present invention is to provide an unloader for side outlet portable containers.

A still even further object of the present invention is to provide an improved seal for the unloader of the side outlet portable containers.

An even further object of the present invention is to provide an unloader for side outlet portable containers without the complexity of a tiltable support.

These and other objects of the invention are attained by suspending the vibratory support from a fixed support by hanger arms under tension. The hanger arms are pivotally connected to the vibratory support and the fixed support and have resilient bushings to accomodate vertical loading while permitting horizontal, reciprocal, rectilinear motion of the vibratory support. The vibratory support includes a discharge orifice which is encompassed by a seal. For side outlet portable containers, the vibratory support includes a first frame portion inclined at a fixed acute angle relative to the horizontal for receiving the bottom of the portable container, and a second frame portion extending substantially perpendicular from the bottom edge of the inclined first frame portion. The second frame portion includes the discharge orifice. A discharge nozzle extends down from the orifice and limits the pivotal motion of the container outlet gate so that the gate forms a portion of the discharge nozzle.

These and other objects of the invention will become apparent from the following detailed description of the preferred embodiments when considered in conjunction with the accompanying drawings.

BRIEF DESCRIPTION OF THE DRAWINGS

FIG. 2 is a front view of the portable container unloader of FIG. 1.

FIG. 3 is a partial cross-sectional view of the suspension system taken along lines III—III of FIG. 1.

FIG. 4 is a second embodiment of the unloader for a side outlet portable container according to the principles of the present invention.

DESCRIPTION OF THE PREFERRED EMBODIMENTS

Figure 1:
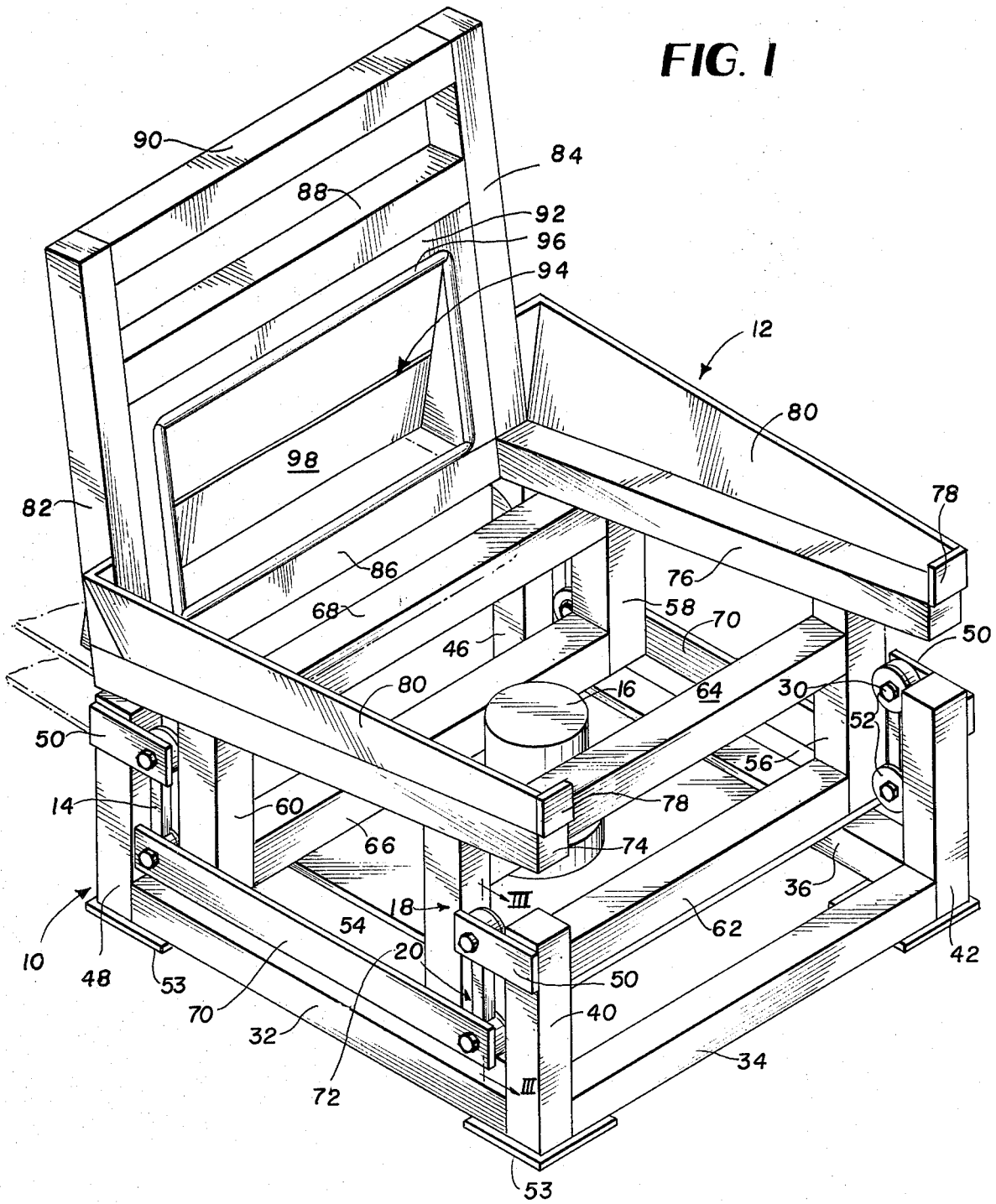
FIG. 1 is a perspective view of an unloader for a portable container having a side outlet and incorporating the principles of the present invention.

An unloader for a portable container includes generally a fixed support 10 and a vibratory support 12 interconnected by a plurality of hanger arms 14. A gyrator or other source of vibration 16 is secured to the vibratory support 12. This general structure is the same for a side outlet portable container unloader as illustrated in FIG. 1 and the bottom outlet portable container unloader of FIG. 5. Each of the hanger arms 14 are pivotally connected at one end 18 to the fixed support 10 and at the other end 20 to the vibratory support 12. By suspending the vibratory support from the fixed support, the hanger arms are under tension.

As illustrated in detail in FIG. 3, each end of the hanger arms 14 includes an aperture 22 in which lies a resilient or rubber bushing 24 and a metallic bearing element 26 interior the rubber bushing 24. A pin 28, for example a bolt, traverses an aperture in the bearing surface 26 and is connected to the appropriate support and is held in place by a nut 30. By connecting the upper portion 18 of the suspension arm 14 to the fixed support 10 and the bottom portion 20 of the hanger arms 14 to the vibratory support 12 below the pivotal connection of the hanger arm 14 to the fixed support 10, the vibratory support is suspended and thereby the hanger arms 14 are under tension. The rubber bushings 24 accomodate unlimited vertical loading without any noticeable vertical displacement of the vibratory support. The pivotal connection of the hanger arms allows complete freedom of movement of the vibratory support 12 relative to the fixed support 14 in the horizontal plane while isolating the fixed support 10 from the vibration of the vibratory support 12. The hanger arms 14 as vibration isolators are superior to the compressional isolators since they have a longer useful life and are not susceptible to vertical displacement. These tension isolators have been used successfully on the vibratory bin activators illustrated in U.S. Pat. No. 3,261,508.

The fixed support includes a substantially rectangular base 32, 34, 36 and 38 having upwardly extending frame members 40, 42, 46, and 48 at the corners thereof. Secured by welding, for example, and extending horizontally from each of the upright frame members 40, 42, 46 and 48 is a plate 50 to which is pivotally mounted the upper portion 18 of the hanger arms 14. A disc 52 is provided on the other side of the hanger arm 14 between the fastener 28 and the nut 30. Feet 53 are provided at the bottom of the four corners of the fixed support 10.

The vibratory support includes a lower frame having uprights 54, 56, 58 and 60 and cross-members 62, 64, 66 and 68. Interconnecting the lower portions of the uprights 54, 56, 58 and 60 and extending past the cross-members are a pair of plates 70. The lower portion 20 of the hanger arms 14 is pivotally mounted to the extended portions of the plates 70. As with the top pivotal connection, disc 52 is provided on the other side of the lower portion 20 of the hanger arm. A plate 72 is secured by, for example, welding to the bottom of cross-members 62 and 66 and extends therebetween. The gyrator or other vibration inducing means 16 is secured to the plate 72. Thus, the gyrator which generally includes an electric motor having a vertical shaft carrying one or more eccentrically mounted weights imparts vibration motion to the lower frame of the vibratory support.

The upper frame includes a pair of spaced, inclined frame members 74 and 76 welded to the top of lower frame uprights 54 and 60 and 56 and 58, respectively. Each of the inclined frame members 74 has a rear guide shoe 78 and a side guide plate 80, both extending up therefrom at an angle thereto. The inclined frame members 74 and 76 are preferrably inclined at 12° angle relative to the horizontal although other angles may be utilized generally within a 6° to 15° range. Extending substantially perpendicular from the lower edge and extending across the inclined frame members 74 and 76 is a front upper frame including uprights 82 and 84 and cross-members 86, 88 and 90.

Affixed to frame members 82, 84, 86 and 88 is a plate 92 having a discharge orifice 94 therein. Encompassing the periphery of discharge orifice 94 is a seal 96 extending from the surface of plate 92. Extending across frame members 82 and 84 and down from plate 92 is a discharge nozzle 98. The discharge nozzle extends partially up across the opening 94 and has a height less than the height of opening 94. When a side outlet portable container is provided on the vibratory support 12, such that the outlet gate or door is positioned adjacent opening 94, the door is opened and swings down so as to engage the upper portion of discharge nozzle 98. Thus, the outlet gate forms a portion of the discharge outlet. Seal or gasket 96 mates with the outlet of the portable container and forms a dustproof seal therewith.

It should be noted that a conveyor may be provided below the discharge nozzle 98 as illustrated in phantom in FIG. 1. With a suspension system which allows horizontal, rectilinear, reciprocal motion while eliminating vertical motion, the material from the portable container is discharged onto the conveyor belt in a uniformly dense state and volume, thereby enhancing conveying accuracy. The suspension system of the present invention restricts vertical motion so as to assure the conveying accuracy. With the configuration illustrated in FIGS. 1 and 2, the reciprocal, rectilinear, horizontal motion is parallel to the axis of the inclined frame members 74 and 76.

Alternatively, the reciprocal, rectilinear, horizontal motion may be transverse to the inclined members 74 and 76. Such an arrangement is illustrated in FIG. 4. The fixed support 10 is constructed having the same elements as that in FIG. 1 with reduced horizontal dimensions. Namely the rectangular frame members 32, 34, 36 and 38 are reduced such that the fixed uprights 42, 44, 46 and 48 are interior the frame elements 54, 56, 58 and 60 of the vibratory support. The upper frame portion of the vibratory support 12 is identical to that of FIG. 1 and thus is not illustrated in FIG. 4. The lower frame of vibratory support 12 is modified although it still includes upright frame members 54 and 56 joined by cross-member 64, and frame elements 58 and 60 joined by cross-members 68. The lower frame lower cross-members 62 and 64 are moved interior the upright members 54, 56, 58 and 60 and rest on added members which connect the bottom of uprights 54 and 60 and 56 and 58, respectively. These new cross-members are not shown in FIG. 4. The support plate 72 is still fastened to the lower cross-members 62 and 66 and the gyrator 16 is mounted to the plate 72 as in FIG. 1.

To produce the change of direction of the horizontal rectilinear motion, the plates 50 and 70 of the supports to which the hanger arms 14 are pivotally connected have been modified. Individual plates 50 of the fixed support to which the upper end of hanger arms 14 are connected, have been replaced by a pair of plates 99 affixed to a pair of upright members 40 and 48 and 42 and 46, respectively. Plates 99 are orthogonal to the original orientation of plates 50 of FIG. 1. The lower end of hanger arms 14 are connected to the vibratory support by individual plates 100 extending from the upright members 54, 56, 58 and 60 of the vibratory support. These individual plates 100 replace and extend orthogonal to the direction of the original pair of plates 70 of FIG. 1. Thus, it can be seen by this specific pivotal connection modification of FIG. 4, the rectilinear, horizontal, reciprocal motion is right and left in FIG. 4 which is transversed to the incline elements 74 and 76.

The FIG. 4 embodiment of the present invention provides a distinct advantage over that of FIG. 1 in that by providing the fixed support 10 interior the lower frame of vibratory support 12, the overall area occupied by the support is reduced. Also, additional space under the upper frame of the vibratory support is provided which protects the suspension system from damage. Since the portable containers are usually manuvered by fork lift trucks, recessing the fixed support from the outer edges of the upper frame portion of the vibratory support, this additional protection is provided. In both embodiments, the isolation system is additionally protected by providing the container support surface of the vibratory support above the hanger arms. It has been found that the embodiment of FIG. 1 and FIG. 4 are equally effective in dispensing material from a material having a side outlet. Thus, the specific direction of the rectilinear horizontal vibration is not critical to the dispensing capability.

The use of the unloader of FIGS. 1 through 4 will now be described. A portable container having a side outlet is positioned on inclined frame members 74 and 76 by a fork lift truck. The guides 78 and 80 provide a visual guide for the fork lift truck driver. The length of inclined frame members 74 and 76 are selected so as to be greater than the longitudinal dimensions of the container. This allows the fork lift truck operator to position the container on the inclined members 74 and 76 displaced from the front upright frame section extending perpendicular from the elements 74 and 76. The gyrator or vibratory means 16 is turned on and the container due to the vibration will walk down the inclined members 74 and 76 positioning and mating its side outlet with dispensing orifice 94. By the container so positioning itself, its weight will automatically compress gasket 96 and form a dust-free seal therewith. The operator then unlocks the gate of the side outlet allowing it to rotate by gravity against the upper portion of discharge nozzle 98. The gyrator is then reactivated to begin the vibration and dispensing of material from the container through discharge nozzle 98.

Although the inclined vibratory support 12 has been described as interconnected to the fixed support 10 by rigid tension hanger arms 14, compression devices may also be used if desired. The structure of the upper frame of the vibratory support offers distinct advantages over the prior art in that it is fixed over adjustable. This reduces the overall costs and extends the useful life of the device. Also, the elimination of the tilting function results in a safer, faster loading cycle.

Figure 5:
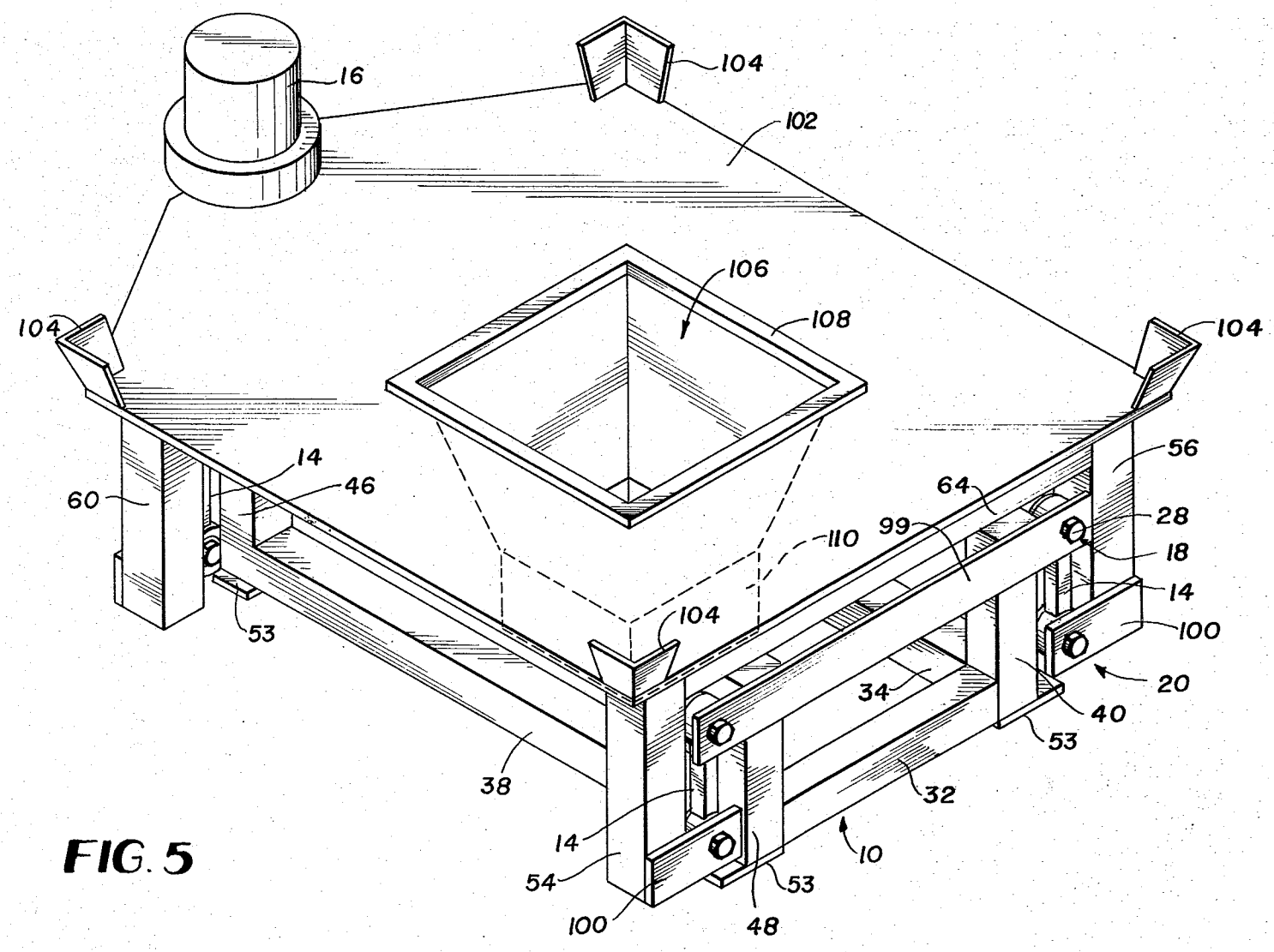
FIG. 5 is a perspective view of an unloader for a bottom outlet portable container incorporating the principles of the present invention.

The use of the rigid, tension suspension system is also applicable to an unloader for bottom discharge portable containers. This is illustrated in FIG. 5. The construction of the fixed support is identical to that of FIG. 4 as is the construction of the lower portion of the vibratory support 12, except for the location of the gyrator 16 and its support structure. The upper portion of vibratory support 12 is modified so as to provide a planar surface 102 secured to the top of the uprights 54, 56 58 and 60 of the lower frame portion. Secured at the corner of the upper frame platform 102 are guide shoes 104. Also a discharge orifice 106 is provided in the center of the plate 102 and surrounded by the compressable gasket 108. The gyrator or vibration inducing means 16 is secured directly to the plate 102 on an extension thereof. This is because the discharge nozzle 110 is centered upon and below the outlet 106 and thus no room is available to mount the gyrator 16 to the lower frame portion of the vibratory support 12. Thus it can be seen that the unique interconnection using rigid tension elements to suspend the vibratory support from the fixed frame is applicable to unloaders for containers having a bottom as well as side outlets.

It is evident from the detailed description of the preferred embodiments that the objects of the invention are attained in that an improved unloader having an improved suspension is provided. Although the invention has been described and illustrated in detail, it is to be clearly understood that the same is but by way of example and illustration only and is not to be taken by way of limitation. The spirit and scope of the present invention is to be limited only by the terms of the appended claims.

What is claimed:

1. An unloader for portable containers comprising:
vibratory support means for receiving and supporting a portable container in a discharge position;
fixed support means;
vibratory means affixed to said vibratory support means for vibrating said vibratory support means and the portable container thereon relative to said fixed support means; and
vibration isolation suspension means under tension interconnecting said vibratory support means and said fixed support means for isolating said fixed support means from the vibration of said vibratory support means and limiting the vibratory motion of said vibratory support means to substantially horizontal motion.

2. The unloader for portable containers according to claim 1 wherein said vibratory support means includes a discharge orifice and means encompasing the perimeter of said discharge orifice on the surface of said vibratory support means for sealing to said discharge orifice a gate of a portable container positioned on said vibratory support means.

3. The unloader for portable containers according to claim 2 wherein said discharge orifice is in a substantially horizontal plane.

4. The unloader for portable containers according to claim 2 wherein said discharge orifice is in a substantially vertical plane.

5. An unloader for portable containers comprising:
vibratory support means for receiving and supporting a portable container in a discharge position;

fixed support means;

vibratory means affixed to said vibratory support means for vibrating said vibratory support means relative to said fixed support means; and suspension means under tension interconnecting said vibratory support means and said fixed support means for isolating said fixed support means from the vibration of said vibratory support means and limiting the vibratory motion of said vibratory support means to substantially horizontal motion, said suspension means including a plurality of rigid hanger arms pivotally connected to said vibratory support means and said fixed support means.

6. The unloader for portable containers according to claim 5 wherein said suspension means includes resilient bushings at the pivotal connection of said hanger arms to said vibratory and fixed support means.

7. The unloader for portable containers according to claim 5 wherein each of said hanger arms are pivotally connected to said fixed support means above where it is connected to said vibratory support means.

8. An unloader for portable containers having side outlets comprising:

fixed support means;

vibratory support means having a first frame means rigidly inclined at an acute angle relative to the horizontal for receiving the bottom of a portable container and supporting it at said angle for discharge of material when vibrated without need for further tilting;

vibratory means affixed to said vibratory support means for vibrating said vibrating support means relative to said fixed support means; and isolation means interconnecting said fixed support means and said vibratory support means for isolating said fixed support means from the vibratory motion of said vibratory support means.

9. The unloader for portable containers according to claim 8 wherein said vibratory support means further includes a second frame means extending substantially perpendicular from a first edge of said first support means at the bottom of said incline and a discharge orifice on said second frame means to mate with the side outlet of a portable container.

10. The unloader for portable containers according to claim 9 wherein said vibratory support means further includes a third and fourth frame means extending up from opposed inclined edges of said first frame means for guiding the placement of a portable container onto said vibratory support means.

11. The unloader for portable containers according to claim 9 wherein said second frame means further includes means encompassing the perimeter of said discharge orifice for sealing the side outlet of a portable container positioned on said vibratory support means to said discharge orifice.

12. The unloader for portable containers according to claim 9 wherein said second frame means further includes a discharge nozzle extending from said discharge orifice.

13. The unloader for portable containers according to claim 12 wherein said discharge nozzle has a height less than the height of said discharge orifice and extends across the width of said discharge orifice for limiting the pivotal motion of a gate of the container's outlet whereby the gate forms part of the discharge nozzle.

14. The unloader for portable containers according to claim 8 wherein said isolation means includes a plurality of rigid hanger arms pivotally connected to said vibratory and fixed support means for suspending said vibratory support means from said fixed support means.

15. The unloader for portable containers according to claim 14 wherein said hanger arms include resilient bushings at the pivotal connection of said hanger arms to said vibratory and fixed support means.

16. The unloader for portable containers according to claim 14 wherein each of said hanger arms are pivotally connected to said fixed and vibratory support means below said first frame means.

17. The unloader of portable containers according to claim 14 wherein said hanger arms are pivotally mounted to limit vibrational motion of said vibratory support means to horizontal, rectilinear, reciprocal motion along the axis of the incline.

18. The unloader of portable containers according to claim 14 wherein said hanger arms are pivotally mounted to limit vibrational motion of said vibratory support means to horizontal, rectilinear, reciprocal motion traverse to the axis of the incline.

19. An unloader for portable containers comprising:

vibratory support means for receiving and supporting portable container in a discharge position;

fixed support means;

vibratory means affixed to said vibratory support means for vibrating said vibratory support means relative to said fixed support means;

suspension means under tension interconnecting said vibratory support means and said fixed support means for isolating said fixed support means from the vibration of said vibratory support means and limiting the vibratory motion of said vibratory support means to substantially horizontal motion; and said vibratory means including a support surface for receiving and supporting a portable container, said support surface being above said suspension means.

* * * * *